US009615710B2

(12) United States Patent
Babenhauserheide et al.

(10) Patent No.: US 9,615,710 B2
(45) Date of Patent: Apr. 11, 2017

(54) FLOOR CARE DEVICE FOR APPLYING A FLOOR CARE FLUID

(71) Applicant: Miele & Cie. KG, Guetersloh (DE)

(72) Inventors: Nils Babenhauserheide, Herford (DE); Markus Penner, Lage (DE); Seyfettin Kara, Spenge (DE); David Buhl, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 0 days.

(21) Appl. No.: 14/932,990

(22) Filed: Nov. 5, 2015

(65) Prior Publication Data

US 2016/0128532 A1 May 12, 2016

(30) Foreign Application Priority Data

Nov. 10, 2014 (DE) ..... 10 2014 116 375

(51) Int. Cl.

| | |
|---|---|
| ***A47L 11/282*** | (2006.01) |
| ***A47L 9/28*** | (2006.01) |
| ***A47L 9/04*** | (2006.01) |
| ***A47L 11/40*** | (2006.01) |
| ***A47L 11/18*** | (2006.01) |
| ***A47L 11/20*** | (2006.01) |

(52) U.S. Cl.

CPC ..... *A47L 9/2852* (2013.01); *A47L 9/0477* (2013.01); *A47L 11/185* (2013.01); *A47L 11/201* (2013.01); *A47L 11/4041* (2013.01); *A47L 11/4083* (2013.01); *A47L 11/4088* (2013.01); *A47L 2201/00* (2013.01); *A47L 2201/04* (2013.01)

(58) Field of Classification Search

CPC .... A47L 9/2852; A47L 11/185; A47L 11/201; A47L 11/4088; A47L 11/4083; A47L 11/4041; A47L 9/0477; A47L 2201/04; A47L 2201/00

IPC ..... A47L 11/282

See application file for complete search history.

(56) References Cited

U.S. PATENT DOCUMENTS

| | | | |
|---|---|---|---|
| 6,260,232 | B1 | 7/2001 | Nelson et al. |
| 2006/0288519 | A1 | 12/2006 | Jaworski et al. |
| 2011/0219555 | A1 | 9/2011 | Field et al. |
| 2014/0208527 | A1 | 7/2014 | Lin |

FOREIGN PATENT DOCUMENTS

| | | | |
|---|---|---|---|
| DE | 202007017026 | U1 | 4/2009 |
| EP | 2730204 | A1 | 5/2014 |
| GB | 903786 | A | 8/1962 |
| GB | 918902 | A | 2/1963 |

*Primary Examiner* — David Redding

(74) *Attorney, Agent, or Firm* — Leydig, Voit & Mayer, Ltd.

(57) ABSTRACT

A floor care device for the care of a floor includes a drive system that moves the floor care device over the floor, a device controller that controls the floor care device over a travel path, and a care apparatus that applies a floor care fluid to the floor. The care apparatus includes a rotatable hollow roller body that stores the floor care fluid, and the floor care fluid emerges from the roller body as the roller body rotates.

18 Claims, 3 Drawing Sheets

Fig. 1
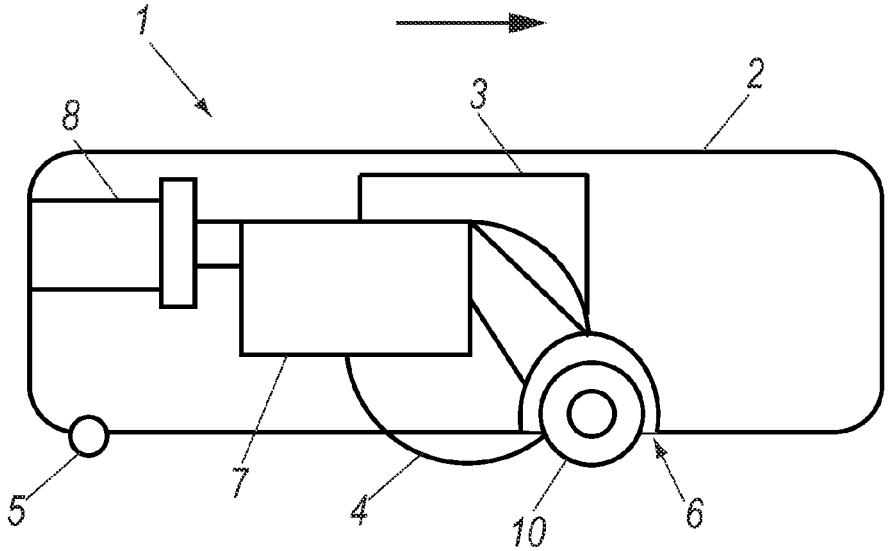
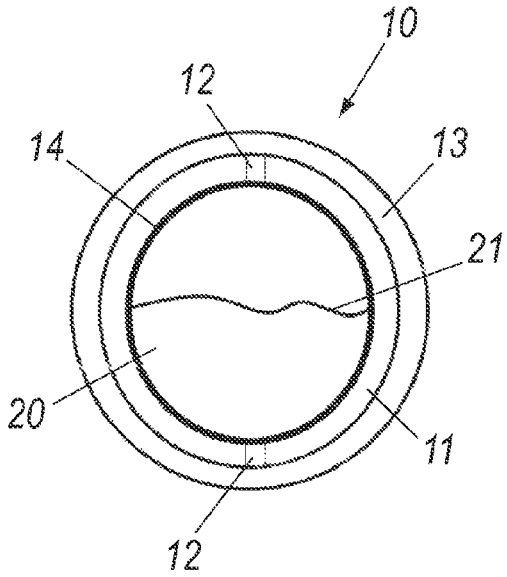
Fig. 2a
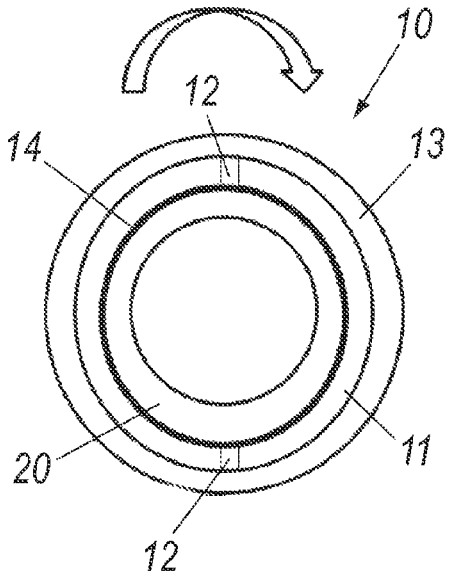
Fig. 2b

Fig. 3
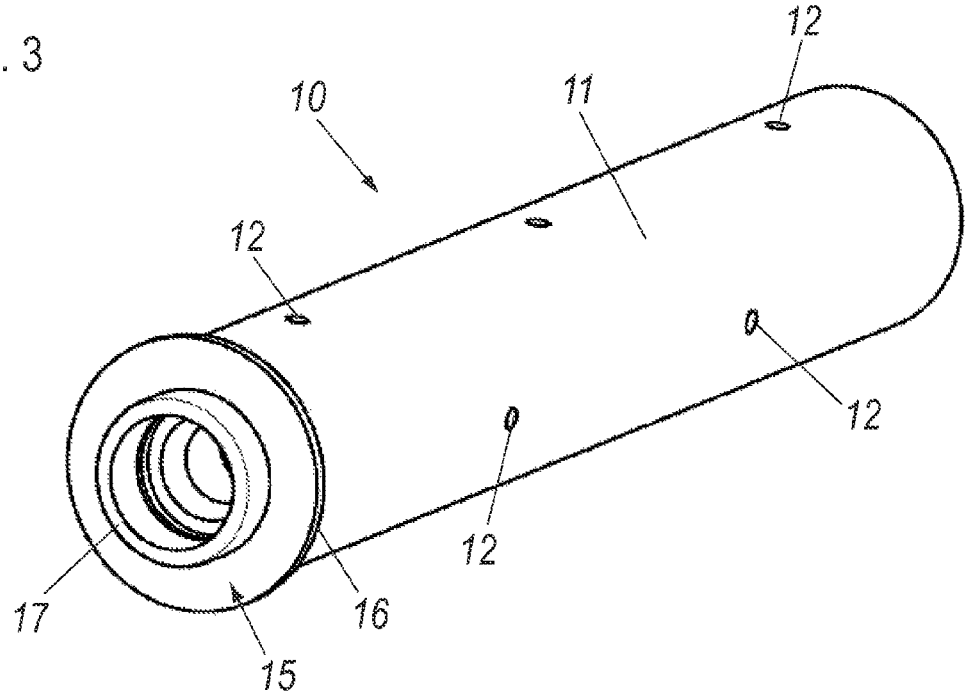
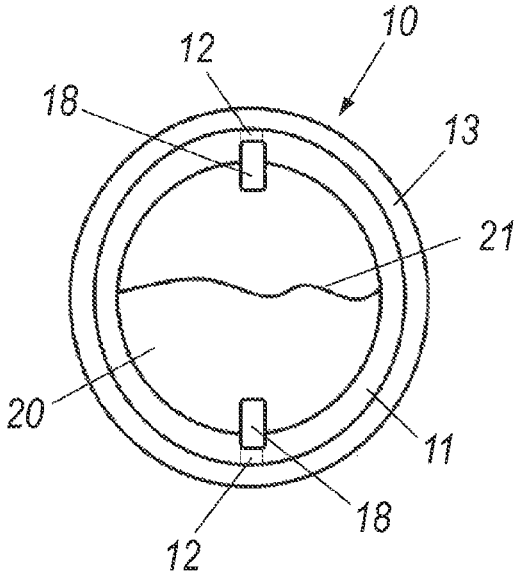
Fig. 4a
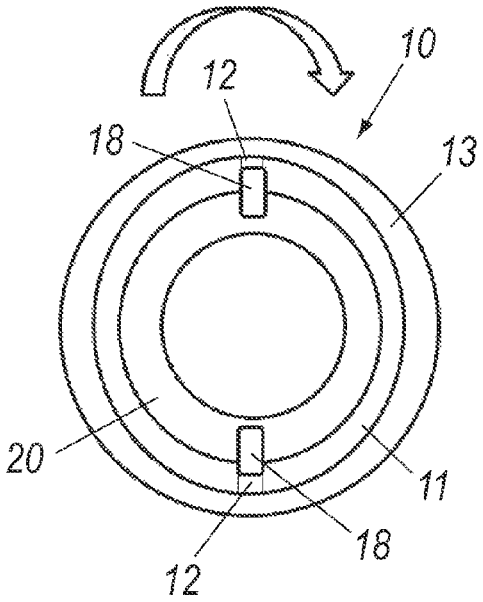
Fig. 4b

FLOOR CARE DEVICE FOR APPLYING A FLOOR CARE FLUID

CROSS-REFERENCE TO PRIOR APPLICATION

Priority is claimed to German Patent Application No. DE 10 2014 116 375.3, filed on Nov. 10, 2014, the entire disclosure of which is hereby incorporated by reference herein.

FIELD

The invention relates to a self-propelled floor care device for the automated care of floors, comprising a drive system for moving the floor care device over the floor to be cared for and a device controller which controls the floor care device over a travel path, and to an apparatus for applying a floor care fluid to the floor to be cared for.

BACKGROUND

Self-propelled floor cleaning devices are used for automated cleaning of floors. They are configured for example as vacuum cleaners, which are then usually referred to as robotic vacuum cleaners. In addition, self-propelled cleaning devices for wiping a floor are also known, as are combined devices which are able to clean by vacuuming and wiping.

In the case of self-propelled cleaning devices for wiping a floor, wiping fluid is usually applied to the floor via spray nozzles, by means of a pump system. A system of this kind is complex and is only appropriate when a larger amount of fluid needs to be applied.

If fluid is applied not primarily for the purpose of cleaning, but rather for care purposes, it is usually sufficient to apply a smaller amount of fluid. Floor care fluids of this kind contain oil or wax for example and are used to care for hard floors such as parquet or wooden flooring.

In order to apply the abovementioned care fluids in small amounts, it is known for example to attach a cloth, soaked in the care fluid, to the underneath of a robotic vacuum cleaner and to thus convert the robotic vacuum cleaner into a self-propelled floor care device. The cloth soaked in the care fluid slides over the floor, either during the vacuuming process itself or in a special travel cycle without the vacuuming function, and dispenses the care fluid in the process. Extending a robotic vacuum cleaner with a care function in this way is uncomplicated, but the output of the care fluid cannot be metered and is also not uniform over the surface. In particular, standstill times of the robotic vacuum cleaner can lead to an undesired point-wise output of care fluid.

SUMMARY

A floor care device for the care of a floor includes a drive system that moves the floor care device over the floor, a device controller that controls the floor care device over a travel path, and a care apparatus that applies a floor care fluid to the floor. The care apparatus includes a rotatable hollow roller body that stores the floor care fluid, and the floor care fluid emerges from the roller body as the roller body rotates.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 1 is a schematic side view of a floor care device comprising a care apparatus;

FIGS. 2*a* and 2*b* are schematic sectional views of a first embodiment of a care apparatus in two different operating states;

FIG. 3 is an isometric representation of a roller body of the care apparatus according to FIG. 2;

FIGS. 4*a* and 4*b* are schematic sectional views of a second embodiment of a care apparatus in two different operating states.

DETAILED DESCRIPTION

Figure 5:
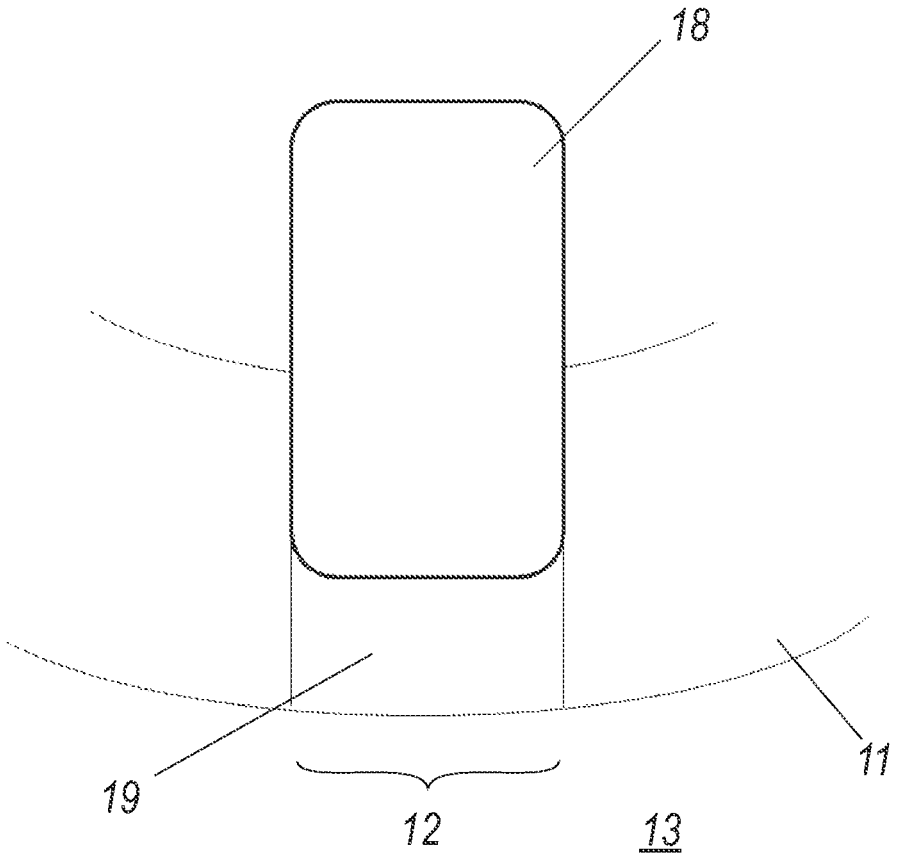
FIG. 5 is a schematic view of a detail of the care apparatus from FIG. 4.

A self-propelled floor care device according to the invention is distinguished in that the apparatus for applying the floor care fluid comprises a rotatable hollow roller body for storing the floor care fluid, the apparatus being configured such that floor care fluid emerges from the roller body as it rotates.

The floor care fluid is dispensed as the roller body rotates, whereas during standstill no floor care fluid is dispensed. Moreover, the rotation of the roller body serves to apply the floor care fluid and work said fluid into the floor, meaning that the floor can also be immediately polished. A floor care device is thus provided which can store floor care fluid and dispense said fluid in a metered manner as needed, without requiring a complex pump system.

In one embodiment, the floor care device is based on a robotic vacuum cleaner, wherein the apparatus for applying the floor care fluid is arranged in a receptacle of a brush roller of the robotic vacuum cleaner in place of the brush roller. Using an apparatus for applying the floor care fluid, which apparatus is designed in terms of the outer dimensions and the mounting thereof so as to be compatible with a brush roller of a robotic vacuum cleaner in such a way as to be easily exchangeable for an available brush roller, a robotic vacuum cleaner can thus be converted in a simple manner into the floor care device.

In a further embodiment of the floor care device, a plurality of holes are arranged in a lateral surface of the roller body. The holes are preferably covered on at least one side by a membrane which particularly preferably comprises a synthetic material. In this case, the membrane can, for example, line the inner side of the roller body or else cover the holes in the form of individual small portions. In this case, the membrane is selected such that the fine porosity thereof prevents the floor care fluid from emerging from the inside of the roller body when the roller body is at a standstill. In the process, the fine porosity of the membrane generates a retaining force which is similar or identical to a capillary holding force which prevents the floor care fluid from emerging from the inside of the roller body when the roller body is at a standstill. When the roller body rotates, the centrifugal forces acting on the floor care fluid exceed the retaining force of the membrane, such that said membrane becomes permeable to the floor care fluid. Consequently, the floor care fluid emerges from the inside of the roller body through the holes.

In an alternative embodiment, the holes which are also present in the lateral surface of the roller body are each sealed by a fibre plug. The fibre plugs preferably contain polyester fibres. The capillary forces of the fibres hold back the floor care fluid, in a manner similar to the abovementioned membrane, provided that the roller body is not rotating.

In a development of this embodiment, the fibre plugs only partially fill the holes in the longitudinal direction thereof, with the result that a free space remains between the outer end of the fibre plugs and the outer circumference of the roller body. In this manner, absorbent materials in contact with the roll of the roller are prevented from coming into direct contact with the outer ends of the fibre plugs, and the fibre plugs prevent floor care fluid from being sucked out of the roller body even when the roller body is at a standstill.

In a further embodiment of the floor care device, an absorbent layer, in particular a nonwoven layer, is arranged on the roller body. This layer can be tubular and slid onto the roller body. Alternatively, the absorbent layer may be wound onto the roller body in webs arranged next to and/or on top of one another. The co-rotating absorbent layer distributes the floor care fluid emerging from the roller body and applies said fluid to the floor. Said layer additionally serves to effectively polish the floor.

In a further embodiment of the floor care device, the roller body is sealed at the axial ends thereof by means of closure caps. Preferably, at least one of the closure caps can be removed in order to pour floor care fluid into the roller body and/or to slide on a tubular absorbent layer. The floor care fluid can thus be poured in and/or replenished in a simple manner. The closure caps may in addition comprise bearings for rotatably mounting the apparatus, for example by comprising a bearing rim. In a simple construction from just a few individual parts, an apparatus for applying the floor care fluid is thus produced which can store, optionally so as to be refillable, meter and apply care fluid. In this case, for applying and metering, the apparatus preferably rotates at a rotational speed of between approximately 400 and 1200 revolutions per minute.

FIG. 1 is a schematic partially sectional side view, in part in cross section, of a modified robotic vacuum cleaner 1 as an embodiment of a floor care device. The robotic vacuum cleaner 1 comprises a drive system 3 which is arranged on or in a housing 2 and acts on two drive wheels 4, arranged one on each side of the robotic vacuum cleaner 1. The drive wheels 4 can be driven, independently of one another, via drive motors of the drive system 3. In addition, a support wheel 5 is provided, which is designed either so as to be pivotable or as a ball which can rotate in all directions. In the case of the rotational direction and/or rotational speed of the drive wheels 4 being controlled independently of one another, the robotic vacuum cleaner 1 can carry out movements over a floor to be cared for, which movements have rotational and translational speeds which can be adjusted independently of one another.

A suction mouth 6 is arranged in the central region of the robotic vacuum cleaner 1 and is connected, in a known manner, to a dust box 7 and a suction fan 8. A filter system, e.g. comprising a vacuum cleaner bag, is arranged in the region of the dust box.

The robotic vacuum cleaner 1 is controlled by means of a device controller which comprises one or more microcontrollers. The device controller controls the individual components of the robotic vacuum cleaner 1, such as the drive system 3 or the suction fan 8. In addition, the device controller comprises a navigation system which plans the travel path of the robotic vacuum cleaner 1 and ensures that the travel path is completed. For the purpose of navigation and in order to prevent collisions with obstacles, long-range and/or short-range sensors are also present which are evaluated by the device controller or the navigation system. These sensors may operate optically or acoustically for example.

The robotic vacuum cleaner 1 shown in FIG. 1 is modified to form a floor care device and therefore comprises an apparatus 10 for applying a floor care fluid, hereinafter referred to as care apparatus 10 for short.

The care apparatus 10 is arranged in the region of the suction mouth 6. It is designed in the shape of a roller and extends over substantially the entire width of the suction mouth 6 and thus also of the robotic vacuum cleaner 1. If the robotic vacuum cleaner 1 shown is used in the unmodified form to clean a floor, a brush roller is usually arranged in place of the care apparatus 10. The brush roller can be rotated by the robotic vacuum cleaner 1 by means of drive motors and, by means of radially protruding bristles, brushes dust and dirt particles out of the fibres of a carpeted floor, for example, in the region of the suction mouth 6 such that said particles can be more easily sucked into the suction mouth 6.

When using the robotic vacuum cleaner 1 as a floor care device, the brush roller is exchanged for the care apparatus 10 shown, which can likewise be rotated by the robotic vacuum cleaner 1. Accordingly, it is possible to quickly and simply switch between using the robotic vacuum cleaner 1 as a floor cleaning device and as a floor care device by means of exchanging the brush roller and/or care apparatus 10. In a development of the robotic vacuum cleaner 1 shown, the switch between the brush roller and care apparatus 10 can also be made automatically, in that a deposit and receiving possibility for the brush roller or care apparatus 10 is provided in the region of a charging station of the robotic vacuum cleaner 1 for example, and therefore the robotic vacuum cleaner 1 can independently exchange said roller and apparatus.

Two embodiments of a care apparatus 10 which can be used to modify the robotic vacuum cleaner 1 according to FIG. 1 to form the floor care device are explained in more detail on the basis of the figures described below.

FIG. 2 is a schematic sectional view, in two sub-images a and b, of a first embodiment of a care apparatus 10. Sub-image a shows the care apparatus 10 in a rest position, whereas sub-image b depicts the care apparatus 10 when it is rotating.

The care apparatus 10 comprises a roller body 11, the central portion of which, through which the section in FIG. 2 is made, is configured as a hollow cylinder. Holes 12 are made in the wall of the roller body 11 so as to be distributed over the circumference and the length of the roller body 11.

FIG. 3 is an isometric representation of a portion of a roller body 11. The holes 12, arranged so as to be distributed in the lateral surface of the roller body 11, can be clearly seen in this depiction. A closure cap 15 is provided on the roller body 11 at either end thereof (just one end region of the roller body 11 is shown in FIG. 3), each closure cap comprising an outwardly protruding collar 16 and a concentric bearing rim 17. The collar 16 laterally delimits the roller body 11 and the bearing rim 17 serves to rotatably mount the roller body 11 on the floor care device, for example the robotic vacuum cleaner 1 shown in FIG. 1. The roller body 11 can also be driven into rotation via the bearing rim 17, for example by means of a friction wheel or in that a sub-portion of the bearing rim 17, viewed in the longitudinal direction of the roller body 11, is provided with teeth. The closure cap 15 may comprise an optionally removable sealing cap inside the bearing rim 17, or alternatively may be rigidly sealed and optionally removable as a whole.

As can again be seen in FIG. 2, a nonwoven layer 13 is arranged on the outside of the roller body 11. The nonwoven layer 13 can be tubular and slid onto the roller body 11 from one side. For this purpose, at least one of the closure caps 15 can be removable, for example screwable or insertable into the roller body 11. Alternatively, the starting material of the nonwoven layer 13 can be planar and laid around the roller body 11 and fixed to the roller body 11 there. An adhesive connection or a connection by means of a hook-and-loop fastener for example are suitable for this purpose. In order to prevent an axially extending seam along the surface of the roller body 11, the nonwoven layer 13 can be pre-cut in such a way that a seam extends in a helical manner, optionally with a number of turns, along the surface of the roller body 11.

A membrane 14 is arranged on the inside of the wall of the roller body 11. The membrane 14 covers at least the holes 12, but can optionally also extend over the entire inner lateral surface of the roller body 11.

In the interior of the care apparatus 10, a cavity is formed by the roller body 11 and the axial closure caps 15 comprising the collar 16 and the bearing rim 17, which cavity is at least partially filled with a floor care fluid 20. In sub-image a of FIG. 2, a floor care fluid 20 of this kind has been poured in up to a level 21.

In the axial direction, the roller body 11 is hermetically sealed by the closure caps 15 in such a way that the floor care fluid 20 cannot escape. Furthermore, the membrane 14 is a permeable membrane which counteracts the hydrostatic pressure exerted on the membrane by the floor care fluid. Accordingly, in the state shown in sub-image a, no floor care fluid 20 escapes through the membrane 14 and through the holes 12 and wets the nonwoven layer 13.

During operation of the floor care device, the care apparatus 10 are rotated, as shown in sub-image b of FIG. 2. In this case, rotational speeds in the range of from approximately 400 to approximately 1200 revolutions per minute are achieved.

As a result of the rotation and the resulting centrifugal forces, the floor care fluid 20 is forced out to the membrane 14. The floor care fluid 20 is also distributed in the inner wall of the roller body 11 substantially in the shape of a hollow cylinder. The centrifugal forces occurring in reaction to the rotation force the floor care fluid 20 through the membrane 14 and subsequently through the holes 12 into the nonwoven layer 13.

The membrane 14 can be a textile membrane for example which is produced from a synthetic material having fine pores. When the centrifugal forces occurring as the care apparatus 10 rotates exceed the retaining force in the membrane 14, the membrane 14 becomes permeable to the floor care fluid 20. For a given membrane 14, a dosage for the amount of floor care fluid 20 dispensed per unit of time can be adjusted by varying the rotational speed.

In order to care for a floor, for example a hard floor such as a laminate or a parquet floor, the floor care device travels over the floor to be cared for with the floor care roller rotating, the nonwoven layer 13 being in contact with the floor surface. For this purpose, the care apparatus 10 can be pressed against the floor, for example in a manner loaded by spring force. Due to the rotation of the care apparatus 10, the floor care fluid 20 is applied via the nonwoven layer 13 to the floor, and at the same time the floor is polished by the nonwoven layer 13. The rotational speed of the care apparatus 10 can be adapted to the travel speed of the floor care device in such a way that a greater travel speed is also accompanied by a greater rotational speed. A uniform application of floor care fluid 20 is achieved in this manner. In particular, it can be provided for the rotational movement of the care apparatus 10 to also be stopped when the floor care device is at a standstill, in order to prevent excessive application of floor care fluid 20 at the corresponding location. During use of the care apparatus 10, the suction fan 8 can be switched off. Alternatively, it is possible to also operate the suction fan 8 in the care mode, optionally at a lower rotational speed than in purely vacuuming operation, in order to vacuum up dirt particles before said particles are taken up or slung away by the rotating care apparatus 10.

FIG. 4, similarly to FIG. 2, is a schematic sectional view through a second embodiment of a care apparatus 10 in two sub-images. Again, sub-image a shows the care apparatus 10 in a rest state and sub-image b shows the care apparatus 10 during rotation. In this and the following figure, identical reference numerals denote identical or identically functioning elements as in the first embodiment.

The basic construction of the care apparatus 10 of the second embodiment corresponds to that shown in FIG. 2 and FIG. 3. Reference is hereby explicitly made to the corresponding description.

In contrast with the first embodiment, however, in the present case a membrane 14 is not provided on the inside of the hollow cylindrical roller body 11. In order to prevent floor care fluid 20 from permanently penetrating through the holes 12 into the nonwoven layer 13, in the present case fibre plugs 18 are arranged in the holes 12. The fibre plugs 18 can for example be inserted in and/or glued to the roller body 11. The fibre plugs 18 are produced from a fibre material, in particular a polyester fibre material. In terms of the construction thereof, the fibre plugs 18 correspond to fibre mines as are used in fibre pins for example. The capillary forces acting inside the fibre plugs 18 prevent the floor care fluid 20 from penetrating into the nonwoven layer 13 when the care apparatus 10 is not in the rotating operating state.

FIG. 5 is a detail of the region of the holes 12 and the inserted fibre plugs 18. It can be seen here that a free space 19 remains between the nonwoven layer 13 and the outer end of the fibre plug 18. The fibre plugs 18 thus do not touch the fibre layer 13, since said plugs are only partially inserted in the hole 12. The free space 19 prevents a capillary effect exerted by the nonwoven layer 13 from also being able to suction the floor care fluid 20 through the fibre plugs 18 in the rest state.

Regarding the use of the care apparatus 10 shown in FIGS. 4 and 5, reference is made to the first embodiment. Just as in the case of the first embodiment, a care apparatus is provided which can store floor care fluid and dispense said fluid in a metered manner as needed, without requiring a complex pump system. The floor care fluid is dispensed due to rotation of the care apparatus, the rotation in addition serving to apply the floor care fluid and work said fluid into the floor and also polish the floor. In both embodiments, the care apparatus can be configured, in terms of the outer dimensions and the mounting thereof so as to be compatible with a brush roller of a robotic vacuum cleaner in such a way as to be easily exchangeable for an available brush roller in order to modify a robotic vacuum cleaner into the floor care device.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 robotic vacuum cleaner
2 housing
3 drive system
4 drive wheel
5 support wheel
6 suction mouth
7 dust box
8 suction fan
10 apparatus for applying floor fluid (care apparatus)
11 roller body
12 hole
13 nonwoven layer
14 membrane
15 collar
16 small rim
17 fibre plug
18 free space
20 floor care fluid
21 level

What is claimed is:

1. A floor care device for the care of a floor, the floor care device comprising:

a drive system configured to move the floor care device over the floor;

a device controller configured to control the floor care device over a travel path; and a care apparatus configured to apply a floor care fluid to the floor, the care apparatus comprising a rotatable hollow roller body configured to store the floor care fluid, the roller body being configured such that floor care fluid emerges from the roller body as the roller body rotates, wherein a plurality of holes are arranged in a lateral surface of the roller body, wherein the holes are covered on at least one side by a membrane, and wherein the membrane lines an inner side of the roller body.

2. The floor care device of claim 1, wherein the membrane comprises a synthetic material.

3. The floor care device of claim 1, wherein the holes are each sealed by a fibre plug.

4. The floor care device of claim 3, wherein the fibre plugs contain polyester fibres.

5. The floor care device of claim 3, wherein the fibre plugs only partially fill the holes in a longitudinal direction of the holes, with the result that a free space remains between an outer end of the fibre plugs and an outer circumference of the roller body.

6. The floor care device of claim 1, wherein an absorbent layer is arranged on the roller body.

7. The floor care device of claim 6, wherein the absorbent layer comprises a nonwoven layer.

8. The floor care device of claim 7, wherein the absorbent layer is tubular and is slid onto the roller body.

9. The floor care device of claim 7, wherein the absorbent layer is wound onto the roller body in webs, and the webs are at least one of arranged next to one another or on top of one another.

10. The floor care device of claim 1, wherein the roller body is sealed at axial ends thereof by closure caps.

11. The floor care device of claim 10, wherein at least one of the closure caps can be removed in order to pour floor care fluid into the roller body or slide on a tubular absorbent layer.

12. The floor care device of claim 10, wherein the closure caps comprise bearings configured to rotatably mount the care apparatus.

13. The floor care device of claim 12, wherein the bearings comprise a bearing rim.

14. The floor care device of claim 1, wherein the care apparatus is configured to rotate at a rotational speed of between approximately 400 and 1200 revolutions per minute.

15. The floor care device of claim 1, wherein the floor care device comprises a robotic vacuum cleaner, and wherein the care apparatus is arranged in a receptacle of a brush roller of the robotic vacuum cleaner in place of the brush roller.

16. A floor care device for the care of a floor, the floor care device comprising:

a drive system configured to move the floor care device over the floor;

a device controller configured to control the floor care device over a travel path; and a care apparatus configured to apply a floor care fluid to the floor, the care apparatus comprising a rotatable hollow roller body configured to store the floor care fluid, the roller body being configured such that floor care fluid emerges from the roller body as the roller body rotates, wherein a plurality of holes are arranged in a lateral surface of the roller body, and wherein the holes are each sealed by a fibre plug.

17. The floor care device of claim 16, wherein the fibre plugs contain polyester fibres.

18. The floor care device of claim 16, wherein the fibre plugs only partially fill the holes in a longitudinal direction of the holes, with the result that a free space remains between an outer end of the fibre plugs and an outer circumference of the roller body.

* * * * *